US008646663B2

(12) United States Patent
Heiberger

(10) Patent No.: US 8,646,663 B2
(45) Date of Patent: Feb. 11, 2014

(54) FLUID CONTAINER CLOSURE MECHANISM WITH DETACHABLE VALVE ASSEMBLY

(76) Inventor: Robert A. Heiberger, Boulder, CO (US)

( * ) Notice: Subject to any disclaimer, the term of this patent is extended or adjusted under 35 U.S.C. 154(b) by 149 days.

(21) Appl. No.: 12/835,547

(22) Filed: Jul. 13, 2010

(65) Prior Publication Data

US 2011/0062191 A1 Mar. 17, 2011

Related U.S. Application Data

(62) Division of application No. 09/237,687, filed on Jan. 26, 1999, now Pat. No. 7,753,234.

(51) Int. Cl.
*B67D 3/00* (2006.01)

(52) U.S. Cl.
USPC ..... 222/525; 222/153.09; 251/350

(58) Field of Classification Search
USPC ..... 222/153.09, 525, 350, 546, 353, 222/519–524, 537
See application file for complete search history.

(56) References Cited

U.S. PATENT DOCUMENTS 2,665,037 A * 1/1954 Zublin ..... 222/490
2,773,632 A * 12/1956 Dobbins ..... 222/525
2,998,902 A * 9/1961 Thomas et al. ..... 222/499
3,201,013 A * 8/1965 Porter et al. ..... 222/525
4,771,919 A * 9/1988 Ernst ..... 222/134
4,817,831 A * 4/1989 Theisen ..... 222/499
5,145,094 A * 9/1992 Perlmutter ..... 222/153.14
5,230,447 A * 7/1993 Kirk ..... 222/505
5,429,282 A * 7/1995 Stebick ..... 222/521
5,472,120 A * 12/1995 Stebick et al. ..... 222/153.06
6,029,855 A * 2/2000 Adams ..... 222/78
6,095,382 A * 8/2000 Gross ..... 222/520
7,661,560 B2 * 2/2010 Murray ..... 222/107

* cited by examiner

*Primary Examiner* — Kevin P Shaver
*Assistant Examiner* — Robert Nichols, II
(74) *Attorney, Agent, or Firm* — Holland & Hart LLP

(57) ABSTRACT

A fluid container is disclosed. The container includes an enclosure for containing liquid and a first closure member. The first closure member is in the form of a fluid discharge assembly which includes a selectively removable valve body mounted for movement between an open position to permit flow of liquid from the enclosure and a closed position to prevent flow of liquid through the fluid discharge assembly. In addition, the closure includes a cap member mountable to a container, and the cap member defines a product outlet passage. The valve body is disposed for movement within the outlet passage between an open position to permit flow of product through the passage from said container and a closed position to prevent flow of product through the passage. The valve body is selectively removable from the outlet passage.

10 Claims, 3 Drawing Sheets

FLUID CONTAINER CLOSURE MECHANISM WITH DETACHABLE VALVE ASSEMBLY

CROSS REFERENCE TO RELATED APPLICATION

This application is a divisional of application Ser. No. 09/237,687, filed on Jan. 26, 1999, now U.S. Pat. No. 7,753, 234.

FIELD OF THE INVENTION

The present invention relates generally to fluid containers and, more particularly, to closure mechanisms for drinking bottles such as sports and water bottles. Specifically, the present invention relates to pop-up type valve assemblies for fluid container closure mechanisms.

DESCRIPTION OF THE PRIOR ART

Refillable plastic drinking bottles and containers with removable tops have been used for many years for conveniently storing and transporting beverages. Numerous closure caps have been developed for such beverage containers to facilitate ease of delivery of the container's contents without spillage utilizing, by way of example, one-way valves, positive closure valves, and devices which act as a seal and closure valve. Sports bottles are one type of such container which are convenient, reusable, flexible plastic drinking bottles with screw-on or snap-on tops. Such bottles are typically provided with either a flexible plastic drinking straw that extends from the outside through a hole in the top, or with a pop-up type drinking spout located centrally on the container top. Examples of such container closure mechanisms include those disclosed in U.S. Pat. Nos. 5,607,073, 5,651,471, 5,669, 427 and 5,788,125 as well as those in International Patent Application No. PCT/NL97/00128 (WO 97/33804), No. PCT/NL97/00277 (WO 97/44247) and No. PCT/EP98/ 00819 (WO 98/38103).

One type of drinking bottle designed for use during active participation in a sports activity is known generally as a sports bottle. A second major type of drinking bottle is generally known as a convenience bottle, and these are typically designed for convenience of transporting and consuming larger amounts of liquid while at rest or on break from an activity, rather than for use during sports participation. Both types of drinking bottles are frequently utilized with snap-on tops containing a reclosable drinking spout, such as a pop-up valve. Such drinking spouts are designed to be opened and closed utilizing one's fingers or teeth.

Such pop-up type drinking valves or spouts are frequently associated with a removable cap. In this manner, the fluid container can be refilled and reused simply by removing the cap and refilling the container. Unfortunately, the pop-up valves or spouts which are utilized with such caps are not removable or capable of being disassembled. This is a significant disadvantage in that material from the fluid passing through the valve or spout, especially sweetened material such as Gatorade or punch, tends to accumulate particulate residue in the spaces between the valve's surfaces. Moreover, since such valves are often opened utilizing one's teeth, saliva and mucous residue can become lodged in such locations. Such residual material in the valve or spout can become a health hazard. In addition, it can also interfere with the proper functioning of the valves or spouts. Consequently, even though such bottles or containers are reusable due to the removability of the container cap, eventually the pop-up valve or spout becomes difficult or unhealthy to use. Therefore, there remains a need for a pop-up type valve or spout useful with fluid containers which are adapted for disassembly for cleaning purposes.

SUMMARY OF THE INVENTION

Accordingly, it is one object of the present invention to provide a fluid container having an improved pop-up type valve assembly.

It is another object of the present invention to provide an improved closure mechanism for fluid containers.

Yet another object of the present invention to provide a valve assembly for manually opening and closing a fluid container that is capable of disassembly for cleaning purposes.

Still another object of the present invention is to provide a valve body for a fluid container closure mechanism which is removable from the container discharge opening.

To achieve the foregoing and other objects and in accordance with the purpose of the present invention, as embodied and broadly described herein, a fluid container is disclosed. The container includes an enclosure for containing liquid and a first closure member. The first closure member includes a fluid discharge assembly which includes a selectively removable valve body mounted for movement between an open position to permit flow of liquid from the enclosure and a closed position to prevent flow of liquid through the fluid discharge assembly.

In yet another embodiment of the invention, an improved closure for a container is disclosed. The closure includes a cap member mountable to a container, and the cap member includes a product outlet passage. A valve body is disposed for movement within the outlet passage between an open position to permit flow of product through the passage from said container and a closed position to prevent flow of product through the passage. The valve body is selectively removable from the outlet passage. In still another preferred embodiment, the valve body is a unitary member constructed from elastic material to permit selective deformation and removal thereof from the outlet passage.

According to the present invention, the fluid discharge or valve assembly is formed as a longitudinally extending sleeve which receives a longitudinally movable valve body that moves between the open and closed positions. The sleeve is provided with one, but preferably two, slots which may be diametrically opposed to one another. The valve body may then include one, but preferably two, stop members in the form of ears disposed on diametrically opposite sides of the valve body. These ears engage the longitudinal slots in the sleeve so that upper and lower edges of the slots in the sleeve define limits for the longitudinal movement of the valve body as the ears respectively contact the upper and lower edges. The portion of the sleeve between the slots accordingly define a guide member so that, in the preferred embodiment, a pair of guide members are respectively oriented along the pair of slots.

The valve body is radially deformable so that the ears may be rotatably advanced onto the inner surface of the guide members thus accomplished since the ears may slide along the inner surface of the sleeve, at the location of the guide members, with the ears being disengaged from the slots that normally limit the longitudinal travel of the valve body. To this end, the stop members in the form of above described ears each have a chamfered surface that forms a wedge along one shoulder edge thereof to assist in the advancement of the ears onto the guide members when the valve body is rotated in a counterclockwise direction.

The fluid discharge or valve assembly also may include a central post that is oriented along the central axis of the sleeve with the valve body being in the form of a cylindrical shell that is positioned in the interior region between the central post and the inner surface of the sleeve. The valve body has a closed outer end that is provided with an aperture. When the valve assembly is in the closed position, the aperture engages the top of the post. However, when the valve assembly is in the open position, the post and aperture are disengaged so that fluid may flow around the central post and out of the aperture. The post may also have support members which face the slots in the sleeve. These support members are in the form of longitudinally extending ribs which resist deformation of the valve body when the ears are engaged in the slots thus resisting removal of the valve body from the sleeve during times when the stop members are positioned in the slots.

BRIEF DESCRIPTION OF THE DRAWINGS

The accompanying drawings which are incorporated in and form a part of the specification illustrate a preferred embodiments of the present invention and, together with a description, serve to explain the principles of the invention. In the drawings:

FIG. 3(*b*) is a side view in elevation of the top portion of the fluid container of FIG. 1 shown with the closure mechanism in the open position;

DETAILED DESCRIPTION OF THE PREFERRED EMBODIMENTS

Figure 1:
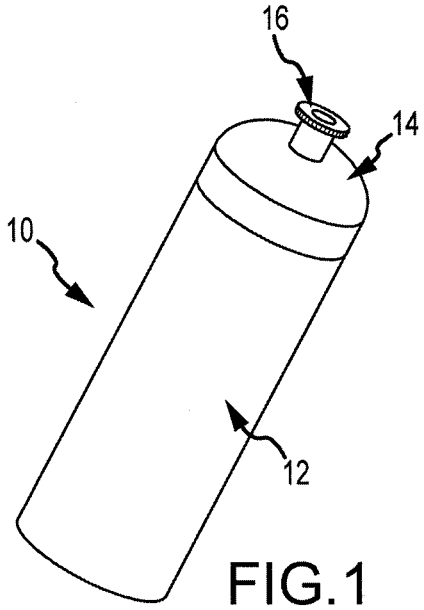
FIG. 1 is a perspective view of a fluid container incorporating the closure mechanism of the present invention.

Referring first to FIG. 1, a fluid container 10 is illustrated and preferably includes a receptacle portion 12, which is designed to house or retain fluid such as water, and a cap portion 14, which is preferably removably secured to the receptacle portion 12. A reclosable pop-up type fluid discharge or valve assembly 16 is preferably incorporated centrally in the top of the cap portion 14 and forms a spout for container 10. It should be understood, however, that the reclosable valve assembly 16 of the present invention may be utilized with any type of fluid container arrangement or structure, and that the cap portion 14 may also be integral with the receptacle portion 12.

While the concept of a pop-up valve or spout for a liquid residue between the pressure sealing surfaces of the movable valve body. This is due to the fact that while the entire spout assembly or cap may be removable from the container for filling the container, the movable valve body itself is fixed within the assembly. This situation not only poses a potential health hazard, but it also increases the friction between the valve bearing surfaces making it difficult to open over time. The valve structure of the present invention includes a valve body which may be removed and cleaned thereby obviating these problems inherent with prior art structures.

Figure 5:
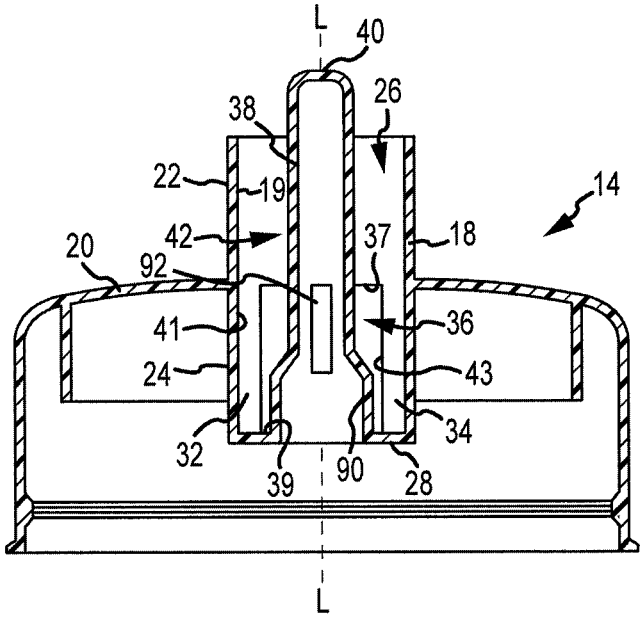
FIG. 5 is a cross-sectional view taken substantially along line 5-5 of FIG. 4.

With reference to FIGS. 2-5, 8 and 9, the valve assembly 16 of the present invention preferably includes a duct in the form of a sleeve 18 which is secured to the container 10. In one preferred embodiment, the sleeve 18 is preferably formed integrally with the container cap 14 and is located at the center of the container cap's upper surface 20. As is best shown in FIG. 5, the sleeve 18 includes an upper portion 22 which projects outwardly above the cap upper surface 20 and a lower portion 24 disposed within the cap 14. The upper sleeve portion 22 terminates an open outer end 26, while the lower sleeve portion 24 terminates in an inner closed end 28. The sleeve 18 functions to discharge fluid from the receptacle 12 as well as to house a removable valve body 30 which controls the flow of fluid through sleeve 18.

Referring more particularly to FIGS. 4-11, the lower sleeve portion 24 and the valve body 30 include interconnecting members that control their movement relative to each other. In preferred form, the 32, 34 which are spaced from each other to form at least one and preferably a pair of slots 36 therebetween and in the walls of the lower sleeve portion 24. Each slot 36 is defined by upper and lower edges 37, 39 as well as side edges 41, 43, which in turn are defined, respectively, by the guide members 32, 34. Inasmuch as the sleeve inner end 28 is preferably closed to fluid flow, the slots 36 provide fluid openings for the flow of liquid from the receptacle 12 through the duct 18. Moreover, as will be described in greater detail below, the slots 36 are part of the referenced interconnecting members which provide an important function with respect to movement control for the valve body 30. It should be noted, however, that more than two slots 36 may be formed in the wall of the lower sleeve portion 24.

In preferred form, a center post or shaft 38 is positioned axially along the central longitudinal axis "L" of the sleeve 18 and is secured and supported at one end to the sleeve inner end 28. The opposite distal end 40 of the shaft 38 is positioned proximate the open upper end 26 of the sleeve 18 and preferably extends outwardly beyond the open upper end 26. The shaft 38 functions as a flow control member in conjunction with the valve body 30 and is spaced radially inwardly from the sleeve 18 so as to create an interior cylindrical space 42 for receiving the valve body 30. Preferably, sleeve 18, closed end 28, guide members 32 and 34 and post 38 are formed as an integrally molded one-piece construction along with cap member 14.

Figure 6:
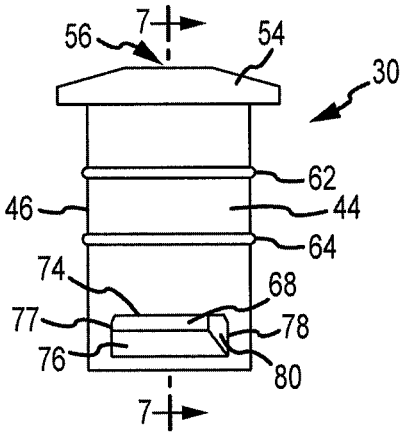
FIG. 6 is a side view in elevation of the valve body utilized in the present invention.
Figure 7:
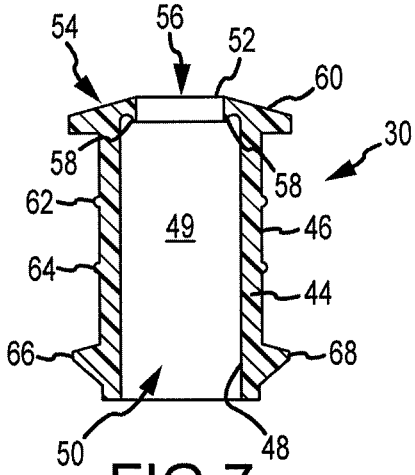
FIG. 7 is a cross-sectional view taken about lines 7-7 of FIG. 6.
Figure 8:
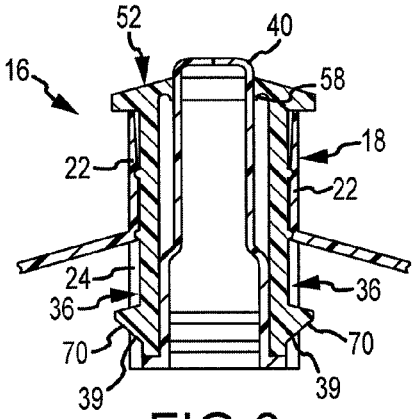
FIG. 8 is a cross-sectional view taken about lines 8-8 of FIG. 3(*a*)

Valve body 30 is best shown in FIGS. 6 and 7 where valve body 30 is substantially tubular in form. The valve body 30 preferably includes a cylindrical shell or sleeve 44 having an outer surface 46, an inner surface 48 defining a central cavity 49, an open first end 50, and a substantially closed second end 52. The closed second end 52 is preferably in the form of a valve cap 54 which has an aperture 56 formed centrally therein. Moreover, an annular lip 58 preferably depends from the upper surface 60 of the valve cap 54 at the aperture 56 to form a fluid-sealing member described in greater detail below. In preferred form, a pair of integrally molded O-rings 62, 64 are disposed about the outer surface 46. It should be noted that the interior and exterior diameters as well as the thickness of the valve sleeve 44 are sized to fit within the interior cylindrical space 42 with the O-rings 62, 64 providing snug engagement with the inner surface 19 of sleeve 18.

Figure 11:
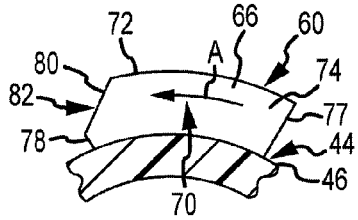
FIG. 11 is a top plan view of a representative stop member of the valve body according to the present invention.

At least one and preferably a pair of stop members 66, 68 are disposed on the outer surface 46 of the valve sleeve 44 diametrically opposite each other and proximate the open end 50 thereof. The stop members 66, 68 are sized and shaped for respective placement within the slots 36 for longitudinal movement therewithin as described below and are also part of the interconnecting members previously referenced. As depicted in FIG. 11, each stop member, such as representative stop member 66, is in the form of an ear 70 projecting radially outwardly from the outer surface 46 of the valve sleeve 44. Each ear 70 preferably includes an outer radial edge 72 which defines an upper shoulder 74 and a lower shoulder 76 with lower shoulder 76 formed at an angle with respect to surface 46 (FIG. 6). Each ear 70 torsional resistance to rotational movement of the valve body 30. A chamfered surface 80 extends from one end shoulder 78 to the radial outer edge 72. As a result of the chamfered surface 80, the end shoulder 78 is substantially smaller than the end shoulder 77 and forms in combination with the chamfered surface 80 a wedge 82 for use in removing the valve body 30 from the sleeve 18 as described in greater detail below.

The valve body 30 is positioned within the sleeve 18 such that the valve sleeve 44 is disposed within the cylindrical space 42 with the stop members 66, 68 being seated and interlocked within their respective slots 36. It should be understood that any number of stop members may be utilized with the valve body 30, there being an equal number of slots 36 formed by appropriate guide members 32, 34. As can be clearly seen in FIGS. 5 and 6, the slots 36 define the limit of movement of the valve body 30 within the duct 18 between its open and closed positions.

Figure 3A:
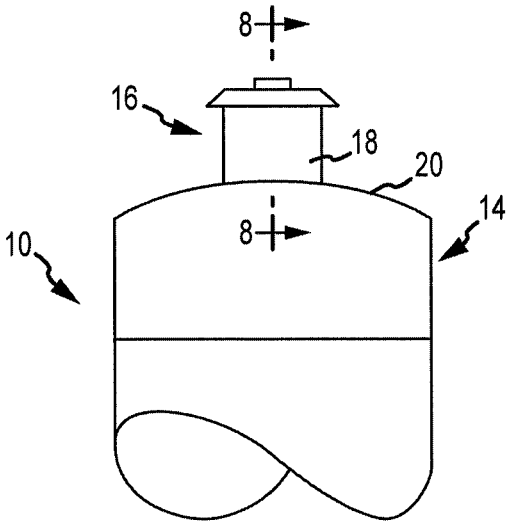
FIG. 3(*a*) is a side view in elevation of the top portion of the fluid container of FIG. 1 shown with the closure mechanism in the closed position.
Figure 3B:
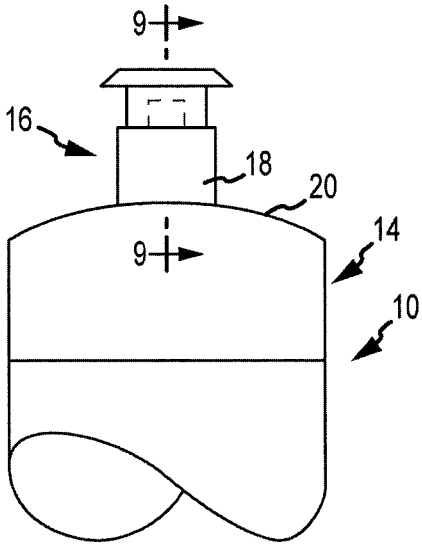
Figure 4:
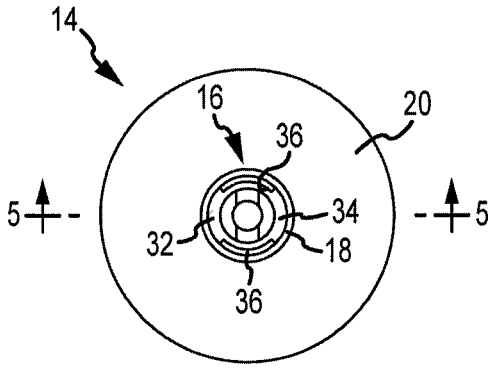
FIG. 4 is a top plan view of the container cap shown in FIG. 2 but with the valve body removed therefrom.

Referring now with particularity to FIGS. 3(*a*), 3(*b*), 8 and 9, it may be appreciated that the flow of fluid through the sleeve or duct 18 is controlled by the position of the valve body 30 therewithin. In preferred form, the valve body 30 is constructed from an elastic material so that it is pliant or deformable to permit it to be selectively removed from the sleeve 18. Preferably, the valve body 30 is constructed from polyurethane, although any other type of elastic or rubber-like material may be utilized. Moreover, the cap 14 including the sleeve 18 and other integrally molded parts are preferably constructed from a harder, non-elastic material such as polyethylene.

Figure 12:
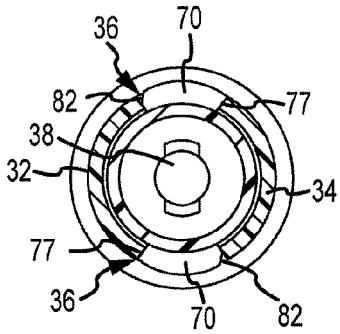
FIG. 12 is a top view in cross-section of the valve assembly according to the present invention shown with the valve body in the retained position.

Referring then to FIGS. 3(*b*) and 9, the valve assembly 16 is in its open position. In this instance, the upper shoulders 74 of the ears 70 abut the upper edges 37 of the slots 36, and fluid flows through the slots 36 through the central cavity 49 and out the through the aperture 56. When it is desired to seal the container 10 and stop the flow of fluid through the aperture 56, the valve body 30 is pressed inwardly at the valve cap 54 until the lower shoulders 76 of the ears 70 abut the lower edges 39 of the slots 36, as is shown in FIGS. 3(*a*) and 8. When this occurs, the distal end 40 of the shaft 38 passes through the aperture 56 and snugly engages the annular lip 58. This engagement seals the aperture 56 and prevents fluid from flowing out of it. As is shown in FIG. 12, end shoulders 77 of each ear 70 prevents clockwise (as viewed from the top) rotational movement of the valve body 30 within be sleeve 18 under normal circumstances inasmuch as the end shoulders 77 abut the side edges 43 of the slot in which the ear is seated. This corresponds to the retained position of valve body 30. Similarly, shoulder 78 will resist unintentional counterclockwise rotation of valve body 30 due to its contact with side edge 41 of the respective slot 36. Moreover, when the valve body 30 is in its closed position, the open first end 50 of the valve sleeve 44 communicates with the interior of the container receptacle 12. This enables the valve body 30 to be radially outwardly deformed when internal pressure within the container increases. This feature of the present invention increases the sealing capacity of the valve body 30 in conjunction with increases in the internal pressure of the container 10.

Figure 2:
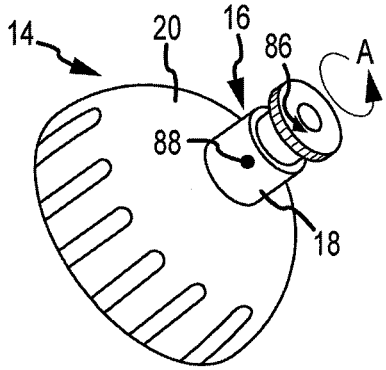
FIG. 2 is a perspective view of a fluid container cap incorporating the closure mechanism of the present invention.
Figure 9:
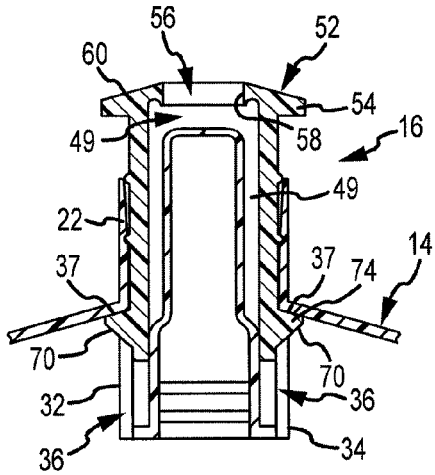
FIG. 9 is a cross-sectional view taken about lines 9-9 of FIG. 3(*b*)
Figure 10:
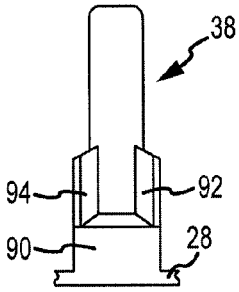
FIG. 10 is a side view in elevation of the central post used for the valve assembly of the present invention.
Figure 13:
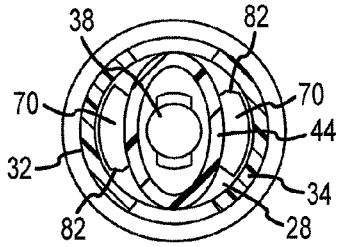
FIG. 13 is a top view in cross-section of the valve assembly according to the present invention shown with the valve body in the release position.

As previously discussed, the valve body 30 is made from elastic material which will permit it to be deformed under certain circumstances. As can be seen from above, the normal operation of the spout 16 involves the longitudinal movement of the valve body 30 within the sleeve or duct 18 between its open and closed positions. When it is desired to remove the valve body 30 from the duct 18 for cleaning purposes, the valve body 30 is placed in its open position as illustrated in FIG. 9. Then, a counterclockwise rotational force is exerted on the valve cap 54 in the direction indicated by the arrow "A", as illustrated in FIGS. 2 and 11. When sufficient rotational force is exerted, the wedge 82 engages a guide member 34 and slot edge 43 and creates a radially inward force against the valve sleeve 44 to deform the valve sleeve 44 radially inwardly, as is shown in FIG. 13. This continues until the ears 70 have compressed the valve sleeve 44 such that the ears 70 are rotated and positioned radially behind the guide members 32, 34, where valve body 30 is in a release position in preparation for disengagement with sleeve 18. Once the valve sleeve 44 has been deformed with the ears 70 compressed behind the guide members 32, 34, as indicated by the markers 86, 88 (FIG. 2), the valve body 30 is then pulled axially outwardly to remove it from the duct 18. When it is desired to reposition the valve body 30 within the duct 18, the markers 86, 88 are realigned, and the above process reversed. To this end, angled lower shoulder 76 helps engage the valve body 30 with the interior of sleeve 18.

Since the valve assembly 16 is frequently moved to its open position by one using one's teeth to pull the valve body 30 outwardly, it is very important that the valve body 30 cannot be removed from the duct 18 accidentally thereby causing a choking hazard. To prevent such inadvertent removal, an annular base member 90 is disposed about the lower end of the shaft 38. Projecting upwardly along the shaft 38 from the base member 90 are a plurality of support elements 92 which are in the form of diametrically positioned, longitudinally extending ribs. There is one such support element 92 for each slot 36 disposed in the duct 18. Each support element 92 is positioned proximate the slot 36 so that it is also adjacent the ears 70 when the valve body 30 is in its operating position within the duct 18. In this manner, the support elements 92 form shoulders along the post or shaft 38. These shoulders prevent the elastic valve sleeve 44 from erroneously deforming when the valve body 30 is pulled excessively in the direction of operation with the ears 70 being positioned within their respective slots 36 and without rotational force being exerted in the direction of the arrow A.

As can be seen from the above, the concept of a pop-up valve or spout for a liquid container is not new. However, existing valve structures accumulate dirt and residue between the pressure sealing surfaces of the movable valve body. This not only poses a potential making it difficult to open over time. The valve structure of the present invention, however, provides a valve body which may be readily removed and cleaned. Thus, both dirt as well as residue from evaporated beverages and saliva may be cleaned from the valve body by such removal and cleaning capability. However, the structure of the present invention requires a positive intentional action to twist the valve for removal. The wedge arrangement of the interlocking ears in the present invention enable the valve body to be deformed and removed only when such positive intentional action is imparted to the valve body cap. Moreover, the present invention includes an arrangement with torsion resistance which prevents unintentional and accidental removal of the valve body from the assembly. Finally, the closure mechanism of the present invention is adaptable for use with virtually any type of drinking bottle or liquid container.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A removable valve body for manually opening and closing a product exit duct communicating with the interior of a fluid container, said valve body comprising:

a unitary body disposed for longitudinal movement within said duct between an open position to permit flow of fluid through said duct and unitary body from said container and a closed position to prevent flow of fluid through said duct and unitary body, said unitary body being constructed from elastic material to permit selective deformation and removal thereof from said exit duct when said unitary body is deformed and rotated relative to said duct, wherein said unitary body comprises a valve sleeve sized and shaped for positioning within said duct, said valve sleeve having an open first end adapted for positioning within said duct and a substantially closed second end adapted for positioning exterior to said duct, said second end having a central aperture therein for communicating with the interior of the container, wherein said valve sleeve further includes at least one stop member in the form of an ear projecting radially outwardly from the outer surface thereof and adapted to limit the longitudinal movement of said valve body within said duct between said open and closed positions, and wherein each said ear includes a radially disposed outer edge, a pair of upper and lower shoulders defined by said outer edge for limiting the longitudinal movement of said stop member within said duct, a pair of end shoulders for limiting rotational movement of said stop member within said duct, and a chamfered surface extending from one said end shoulder to said outer edge to form a wedge adapted for engagement against said duct in response to selective rotational force imposed on an end cap when said valve body is in its open position to assist in deforming said unitary body radially inwardly.

2. The valve body of claim 1, wherein said second end includes a valve cap sized and shaped for closing the second end of said duct when said valve body is in a closed position.

3. The valve body of claim 2, wherein said valve sleeve includes at least one integrally molded O-ring disposed about the outer surface thereof

4. A valve assembly for manually opening and closing a fluid container discharge opening and adapted for disassembly for cleaning purposes, said valve assembly comprising:

(a) a fluid discharge sleeve enclosing said discharge opening and extending longitudinally with respect thereto, said discharge sleeve having an outer end opening and an inner end opening;

(b) a shaft extending longitudinally along a central axis of said discharge sleeve, said shaft having a distal end portion proximate the outer end opening of said discharge sleeve; and (c) a detachable valve body disposed for movement along said shaft within said discharge sleeve between an open valve position to permit flow of fluid product through said discharge opening from said container and a closed valve position to prevent flow of product through said discharge opening, said valve body being selectively removable from said discharge sleeve when said detachable valve body is rotated relative to said discharge, wherein said valve assembly includes stop members disposed between said discharge sleeve and said valve body to limit the longitudinal movement of said valve body within said discharge sleeve and to selectively restrict rotational movement of said valve body within said discharge sleeve, said stop members comprising at least one stop member disposed on the outer surface of said valve body and at least one slot defined in said discharge sleeve, each said stop member being seated within one said slot with the length of said slot defining the longitudinal movement of said valve body within said discharge sleeve between said open and closed positions, and wherein said valve body is constructed from elastic material, and wherein each said stop member projects radially outwardly from said elastic valve body and includes a surface adapted for engaging said collar in response to selective rotational force imposed on said valve body in its open position to radially compress and deform said valve body for selective detachment from said discharge sleeve.

5. The valve assembly of claim 4, wherein said valve body is constructed from elastic material arid is radially deformable for selective detachment from said discharge sleeve.

6. The valve assembly of claim 5, wherein said valve body includes a central cavity sized and shaped for mounting along said shaft and a closed outer end portion disposed exterior to said discharge sleeve outer end opening and having a central aperture defined therein, said central aperture being sized and shaped to engage said shaft distal end portion when said valve body is in said closed position.

7. The valve assembly of claim 6, wherein the central aperture of said outer end includes an annular lip member extending inwardly into said central cavity to provide a sealing surface with said shaft distal end portion when said valve body is in said closed position.

8. In a pop-up valve assembly for manually opening and closing a fluid container including a product exit port and a valve body longitudinally movable relative to said port between an extended open position for fluid discharge and a depressed closed position for fluid containment, the improvement wherein said valve body is constrained for movement between the open and closed positions yet which includes means for selectively disengaging and removing said valve body from said port when said valve body is rotated relative to said port, wherein said means comprises said valve body being constructed from elastic material and being radially deformable for selective detachment from said port wherein said product exit port is substantially tubular in form having an outer end opening and an inner end opening and includes a shaft extending axially along the centerline thereof, said shaft having a distal end portion proximate the outer end opening of said port, and wherein said valve body includes a central cavity adapted for axial movement along said shaft within said port and a closed outer end portion having a central aperture defined therein, said central aperture being sized and shaped to engage said shaft distal end portion when said valve body is in said closed position and disengage said shaft distal end portion when said valve body is in said open position, and wherein said valve body includes at least one stop member projecting radially outwardly therefrom, wherein said tubular port includes guide members for defining at least one longitudinal slot within said port, each said stop member being seated within one said slot to both limit the longitudinal movement and restrict rotational movement of said valve body within said sleeve, and wherein each said stop includes a surface adapted for engaging a guide member in response to selective rotational force imposed on said valve body in its open position to radially compress and deform said valve body for selective detachment from said discharge sleeve.

9. The improvement of claim 8, wherein said shaft includes support elements disposed between said shaft and said valve body aligned proximate said slots to prevent the axial removal of said deformable valve body from said exit port while said stop members are positioned within said slots.

10. The improvement of claim 8, wherein said fluid container includes a removable top portion which contains said pop-up valve assembly, and wherein said top portion, said exit port, said shaft and said support elements comprise one integral unit.

* * * * *